US005400962A

United States Patent [19]

Adams et al.

[11] Patent Number: 5,400,962

[45] Date of Patent: Mar. 28, 1995

[54] SYSTEM AND METHOD FOR REDUCED PURGE OPERATION OF A FORCED DRAFT BURNER IN A WATER HEATER

[75] Inventors: Richard C. Adams; Charles L. Adams, both of Fort Worth, Tex.

[73] Assignee: PVI Industries, Inc., Fort Worth, Tex.

[21] Appl. No.: 144,148

[22] Filed: Oct. 27, 1993

[51] Int. Cl.[6] ..... F23N 1/08; F22B 37/42

[52] U.S. Cl. ..... 236/20 R; 236/1 E; 122/448.1; 431/12

[58] Field of Search ..... 236/15 B, 15 D, 1 A, 236/20 R, 78 D, 1 E, 1 EB; 431/12, 20 R; 237/8 R; 122/448.1

[56] References Cited

U.S. PATENT DOCUMENTS

| | | | |
|---|---|---|---|
| 3,469,590 | 9/1969 | Barker | 236/78 D X |
| 3,960,320 | 6/1976 | Slater | 236/15 BD |
| 4,406,611 | 9/1983 | Michel | 236/15 BD |
| 4,519,540 | 5/1985 | Boulle et al. | 431/12 X |
| 4,676,734 | 6/1987 | Foley | 236/15 BD |
| 4,713,525 | 12/1987 | Eastep | 236/46 R |
| 5,844,335 | 7/1989 | McKinley et al. | 219/308 |

*Primary Examiner*—William E. Wayner
*Attorney, Agent, or Firm*—Charles D. Gunter, Jr.

[57] ABSTRACT

A system and method for controlling operation of a water heater provides generating a heating demand signal which a minimum level corresponds to a required heat input for maintaining water temperature in the water tank in case of no exogenous demand for water. Responsive to the heating demand signal, air flow from the forced draft blower and flow of combustible fluid from the combustible fluid delivery system are varied to produce combustion product over a minimum 15 to 1 ratio. This allows water heating to be varied to meet maximum expected exogenous demand or to maintain water temperature with no exogenous demand.

8 Claims, 2 Drawing Sheets

SYSTEM AND METHOD FOR REDUCED PURGE OPERATION OF A FORCED DRAFT BURNER IN A WATER HEATER

BACKGROUND OF THE INVENTION

1. Field of the Invention

The invention relates to forced draft water heaters or boilers and particularly to a forced draft water heater or boiler providing efficient water heating at all demand levels, substantially without interruption of burner operation.

2. Description of the Prior Art

Water heaters or boilers employing forced draft burners have used control systems to respond to variations in exogenous demand for hot water from the water heater or boiler. U.S. Pat. No. 4,519,540 to Boulle et al., teaches a water boiler in which heat input to the water boiler is adjusted for exogenous demand, while taking into account various environmental factors and user history. The variables controlled to control heat input are gas flow to a burner and speed of a fan providing the forced air flow. Gas flow and air flow into a combustion chamber are adjusted with reference to one another to produce complete burning without excess air being drawn. Excess air flow results in higher than required motor loads and the need to heat greater quantities of air than needed to meet burner demand.

Boulle et al., however, define demand for heating of the water in terms of an order from a consumer, i.e. exogenous demand. When no exogenous demand exists, circulation of hot water is eliminated, fan or blower speed is reduced to 50% of nominal and the burners (except for a pilot) are turned off. The continuing flow of air from the blower, however through the combustion chamber will extract heat from the boiler.

Periodic or occasional shutdown of burners in large, commercial scale water heaters and boilers requires a purge of the combustion chamber after heating is discontinued and before it resumes. A purge is acceleration of air flow through the combustion chamber with no gas flow, done to assure no stray gas is left in the chamber when combustion resumes. If any gas is left in the chamber, resumed burning may result in ignition of the stray gas in an undesired portion of the combustion chamber or in an exhaust stack. Some potential for explosion exists under such conditions. However, purging of a combustion chamber by forcing unheated air through the chamber may be thermally wasteful.

SUMMARY OF THE INVENTION

It is therefore one object of the invention to provide an improved method of operating a forced draft water heater.

It is another object of the invention to provide a system and method for operating a forced draft water heater providing efficient water heating at all demand levels without interruption of burner operation.

The foregoing objects are achieved as is now described. The system and method of the invention are directed to meeting, at all times, heating demand ranging upward from minimum systemic demand. In a water heater comprising, a water tank, a combustion chamber for heating water in the water tank, a blower for delivery of forced air to the combustion chamber and a controllable gas delivery system for delivery of gas to the combustion chamber, the invention provides a method of generating a heating demand signal which a minimum level corresponds to a required heat input for maintaining water temperature in tile water tank with no exogenous demand for water, and responsive to the heating demand signal, varying air flow from the forced draft blower and flow of combustible fluid from the combustible fluid delivery system to produce combustion product over a minimum 15 to 1 ratio by volume. At such combustible mixture delivery rates, water heating can be varied to meet most maximum expected exogenous demands, or to maintain water temperature with no exogenous demand, in water heaters of contemporary thermal retention capabilities.

Additional objects, features and advantages will be apparent in the written description which follows.

DETAILED DESCRIPTION OF THE INVENTION

Figure 1:
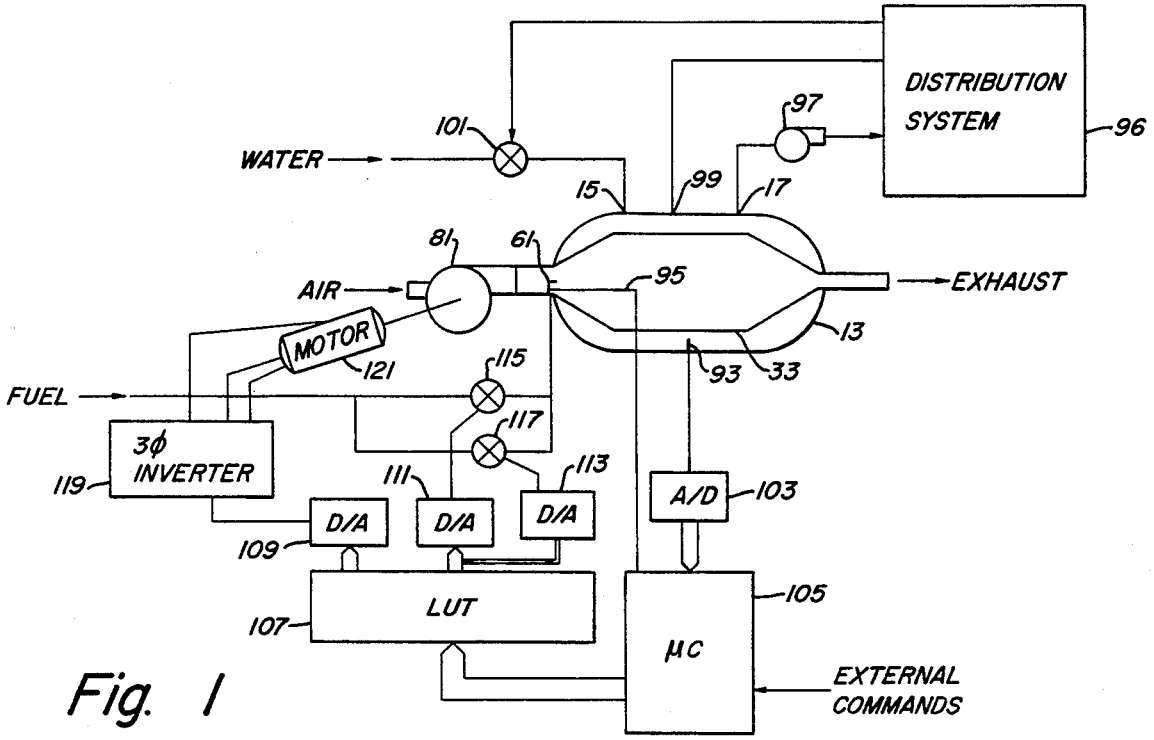
FIG. 1 is a schematic view of a gas delivery and forced draft system for use with a water heater.

Turning to FIG. 1, a schematic illustration of a water heating system with distribution and control components is illustrated. Air in a combustion chamber assembly 33 is heated by burning natural gas introduced through a burner nozzle 61 to warm water held in storage tank 13. Water may be tapped through an outlet valve 17 via pump 97 to a distribution 96 which may or may not return water to tank 13 by an inlet nozzle 99. Distribution system 96 includes some flow measuring component to control a valve 101 controlling addition of water to tank 13 through inlet valve 15. Within storage tank 13 is a temperature sensor 93 and within combustion chamber 33 is a burner flame out sensor 95. Temperature signals from temperature sensor 93 are converted to a digital format by analog to digital converter 103 and applied to a microcontroller 105. A signal generated by burner flame out sensor 95 may be applied to microcontroller 105 as an interrupt. Microcontroller 105 may also receive external commands such as a command to shut off burner 61. Water temperature is the most important indicator in determining required heating of water in storage tank 13 to maintain a preferred operating temperature. However, many other variables could be measured and used to predict heating demand such as ambient temperature, caloric value of fuel, ambient air pressure, distribution system 96 demand, etc. Microcontroller 105 generates an address into a lookup table 107 for control of flow of air and fuel into combustion chamber 33. The address signal is akin to a heating demand signal.

In the simplest case, where demand for heating is inversely proportional to water temperature, lookup table 107 comprises a list of addresses corresponding to two part control outputs. The two parts of the control outputs for each address are a motor speed demand signal and a gas flow demand signal. The components are applied to digital to analog converters 104 and 111 respectively to generate analog demand signals. Gas flow control includes parallel gas valves 115 and 117. Gas valve 115 is larger in capacity than gas valve 117 and is used for gross flow control while gas valve 117 is used for fine control of flow. Alternatively, a single gas valve may be used if it can provide reliable gas flow metering over a range of about 20 to 1 by volume. The most significant bits of the gas flow output component are applied to digital to analog converter 111 for control of valve 115, while the least significant bits are applied to digital to analog converter 113 for application to valve 117. Digital to analog converter 109 provides a motor speed demand signal from digital value and applies it to three phase inverter 119 for control of motor 121 driving blower 81. Three phase inverter 119 and motor 121 provide variable speed control of an alternating current motor by varying the output frequency of the three phase inverter. Microcontroller 105 may be provided by a Series 9030 programmable controller available from GE Fanuc Automation North America Inc. Inverter 119 may be provided by a AF-300A inverter available from General Electric Company, Drives Products Operation, Erie, Pa. 16531.

Figure 2:
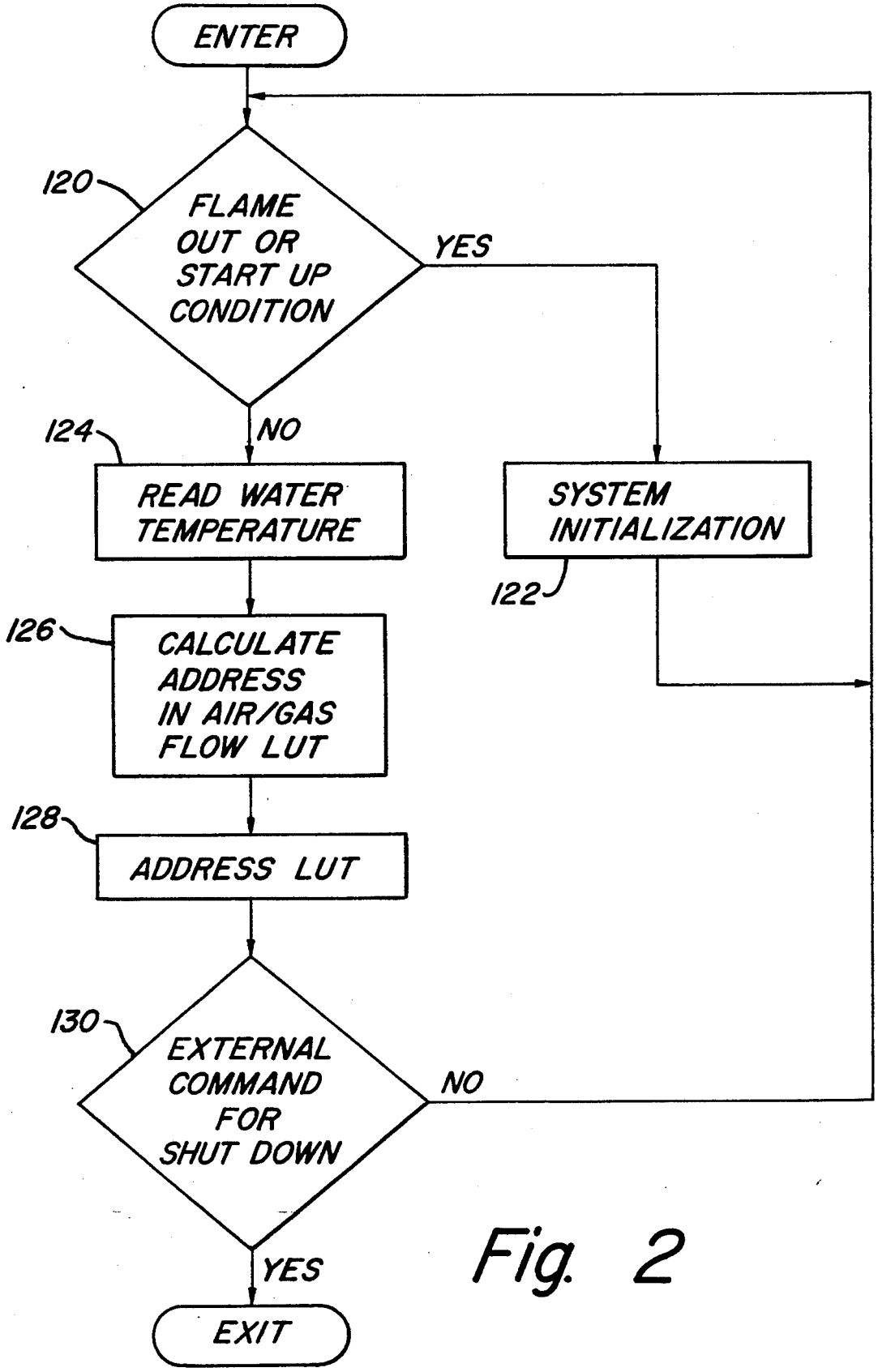
FIG. 2 is a logical flowchart of a process executed by a microcontroller or digital signal processor utilized in practicing the invention.

FIG. 2 is a high level flowchart of a process executed by microcontroller 105. Upon entering the process, step 120 is executed to determine if a flame out or startup condition is present. Those skilled in the art will understand that a flame out interrupt will move processing of the program to step 120 from any other point in the program for reinitialization. If YES, step 122 follows for system initialization which includes high speed operation of blower 81 for purposes of purging combustion chamber assembly 33 prior to ignition of burner 61. Step 122 returns to step 120 to assure that burner 61 is in operation. Following the NO branch from step 120, step 124 is executed to read water temperature. Next, step 126 is executed to calculate an address for air gas flow for use in application to lookup table 107. Next, step 128 is executed to apply the address to the lookup table. Next, at step 130, external interrupt lines are examined to assure that no command for shutdown has been received. If a shutdown command has been received, the burner in shutoff and the process is exited. If NO shutdown command is received the process is returned to step 120 indicating continuing observation for a flame out condition and adjustment of the heat demand signal.

Substantial gains in operating efficiency may be achieved in some installations by avoiding periodic shutdowns of burner operation for a water heater with consequent purge operations to eliminate stray or trace gas. Whenever a burner turns off, both a post-operation purge and pre-operation purge must be done both of which waste heat. By achieving control ratios over fuel and air volume flow from maximum to minimum of 15 to 1 or greater, combustion product may be varied over a 15 to 1 ratio. Burner operation may thereby be reduced to a rate of heat input to the system which allows simple maintenance of water temperature without shutdown of the burner without loss of maximum heating capacity.

While the invention has been particularly shown and described with reference to a preferred embodiment, it will be understood by those skilled in the art that various changes in form and detail may be made therein without departing from the spirit and scope of the invention.

What is claimed is:

1. A working fluid heating apparatus comprising:

a vessel for holding working fluids;

a combustion chamber positioned with respect to the vessel for heat exchange therewith;

a controllable air blower coupled to said combustion chamber for supplying a selectable volume of air over a substantially continuous volume range in response to a variable air blower control signal;

a controllable combustion fluid valving apparatus coupled to said combustion chamber for delivering a selectable volume of combustible fluid over a substantially continuous volume range in response to a variable combustible fluid control signal;

a burner within said combustion chamber for producing a combustion product from said air and said combustible fluid;

a temperature sensor for generating a working fluid temperature signal;

a microcontroller for calculating a heating demand signal from said working fluid temperature signal; and a lookup table for returning a selected air blower control signal and a selected combustible fluid control signal in response to a particular heating demand signal wherein a desired ratio of air and combustible fluid may be coupled to said burner.

2. The working fluid heating apparatus according to claim 1 wherein said controllable air blower includes a variable speed motor.

3. The working fluid heating apparatus according to claim 2 wherein said motor comprises an alternating current motor and a frequency adjustable inverter for energizing the alternating current motor.

4. The working fluid heating apparatus according to claim 1 wherein said controllable combustible fluid valving apparatus comprises a plurality of parallel connected valves of diverse capacities.

5. In a working fluid heating apparatus having a vessel for holding the working fluid, a combustion chamber communicating with the vessel for heat exchange, a forced draft blower and a combustible fluid delivery system, a method of operating the working fluid heating apparatus comprising:

generating a heating demand signal which at a minimum level corresponds to a required heat input for maintaining working fluid temperature in the vessel tank with no exogenous demand for working fluid outflow from the vessel;

responsive to the heating demand signal, varying air flow from the forced draft blower and flow of combustible fluid from the combustible fluid delivery system; and sustaining burning from the combustible fluid and the air flow when the heating demand signal is at the minimum level.

6. The method of claim 5, wherein the step of varying air flow and flow of combustible fluid is over a minimum range to produce a desired ratio in combustion product.

7. Water heating apparatus comprising:

a water tank;

a combustion chamber communicating with the water tank for heat exchange;

a forced draft blower;

a combustible fluid delivery system;

means for generating a heating demand signal which a minimum level corresponds to a required heat input for maintaining water temperature in the water tank with no exogenous demand for water; and means responsive to the heating demand signal for varying air flow from the forced draft blower and flow of combustible fluid from the combustible fluid delivery system to meet the heating demand signal at the minimum level or greater levels.

8. The water heating apparatus of claim 7, wherein the means for varying air flow and flow of combustible fluid provide variation over a minimum 15 to 1 ratio by volume in combustion product from air and the combustible fluid.

* * * * *